United States Patent [19]

Ogawa

[11] 4,174,506

[45] Nov. 13, 1979

[54] THREE-PORT LUMPED-ELEMENT CIRCULATOR COMPRISING BYPASS CONDUCTORS

[75] Inventor: Hiroshi Ogawa, Tokyo, Japan

[73] Assignee: Nippon Electric Co., Ltd., Tokyo, Japan

[21] Appl. No.: 862,833

[22] Filed: Dec. 21, 1977

[30] Foreign Application Priority Data

Dec. 24, 1976 [JP] Japan ..... 51-155939

[51] Int. Cl.[2] ..... H01P 1/38

[52] U.S. Cl. ..... 333/1.1; 333/238

[58] Field of Search ..... 333/1.1

[56] References Cited

U.S. PATENT DOCUMENTS

| | | | |
|---|---|---|---|
| 3,538,459 | 11/1970 | Knerr | 333/1.1 |
| 3,605,040 | 9/1971 | Knerr et al. | 333/1.1 |
| 3,836,874 | 9/1974 | Maeda et al. | 333/1.1 |
| 3,895,320 | 7/1975 | Kafoh | 333/1.1 |

*Primary Examiner*—Paul L. Gensler

*Attorney, Agent, or Firm*—Ostrolenk, Faber, Gerb & Soffen

[57] ABSTRACT

An assembly of lumped-element conductors of a three-port circulator comprises those three first conductors connected to one another and to the ports and those three second conductors connected to the respective points of connection between the first conductors which are arranged on a principal surface of at least one magnetically stationarily biased ferrimagnetic piece so as to have a threefold axis of rotational symmetry passing perpendicularly of the principal surface through a point predetermined on the surface with the second conductors extended on the predetermined point and within an area enclosed with the first conductors. Preferably the area enclosed with the first conductors is an equilateral triangle. The second conductors are either connected between the apices of the triangle with the center of gravity or extended along the median lines. A conductor plate to which the ports are connected through capacitors and a dielectric plate are interposed between the other principal surface of the ferrimagnetic piece and a ground conductor. Alternatively, a common area of the second conductors that is situated on the predetermined point is electrically connected through the ferrimagnetic piece to the ground conductor that is placed directly on the other principal surface and connected to the respective ports through capacitors. A control circuit may be connected between the ground conductor and ground.

4 Claims, 13 Drawing Figures

THREE-PORT LUMPED-ELEMENT CIRCULATOR COMPRISING BYPASS CONDUCTORS

BACKGROUND OF THE INVENTION

This invention relates to a three-port lumped-element circulator.

A circulator of the type described is often used in a microwave communication system and comprises three ports, at least one ferrimagnetic piece, a magnet for producing a stationary magnetic field in the adjacency of the ferrimagnetic piece or pieces to magnetically stationarily bias the same, and an assembly of lumped-element conductors connected on the ferrimagnetic piece to the ports. An input microwave signal supplied to one of the ports that is selected as an input port is circulated to one of the two remaining ports that is predetermined as an output port. As will later be described with one of several figures of the accompanying drawing, the lumped-element conductor assembly of a conventional circulator of the type specified consists of three elongate conductor members. Each of the conductor members has a first wide conductor on one end thereof to serve as one of the ports, a pair of thin conductors extended parallel from the wide conductor to be intertwined with the thin conductors of two other conductor members on a center area of the ferrimagnetic piece, and a second wide conductor uniting the two thin conductors on the other end of the conductor member. The thin conductors are weak against the mechanical shock and liable to break during assembly of the circulator. Moreover, it is inevitable that another ferrimagnetic piece, if used, is appreciably spaced from the ferrimagnetic piece on which the assembly is arranged. As will also later be described with reference to another of the several figures, the conductor assembly of another conventional circulator disclosed by R. H. Knerr in U.S. Pat. No. 3,716,805 consists of a single ring-shaped conductor. Each portion of the single conductor that is connected to two adjacent ports serve as a lumped-element conductor. The single conductor is strong against shock, facilitates manufacture of the circulator, and enables another ferrimagnetic piece, when used, to be brought close to the ferrimagnetic piece that is indispensable as the circulator. It is, however, difficult to achieve a wide operable band width with the conventional circulators.

SUMMARY OF THE INVENTION

It is therefore an object of this invention to provide a lumped-element circulator which has a wide usable frequency band.

It is another object of this invention to provide a lumped-element circulator of the type described which is strong against mechanical shock.

According to this invention, a three-port lumped-element circulator comprises, three ports, a ferrimagnetic piece having a principal surface and a predetermined point on said principal surface, means for producing a magnetic field substantially perpendicularly of said principal surface, three first conductors connected to the respective ports and to one another at three points of connection to enclose an area of said principal surface, and three second conductors connected to one another and to the respective points of connection and placed in said area and on said predetermined point. The ports, the first conductors, and the second conductors are arranged on said principal surface substantially in a geometric configuration having a threefold axis of rotational symmetry that passes perpendicularly of said principal surface through said predetermined point.

DESCRIPTION OF THE PREFERRED EMBODIMENTS

Figure 1:
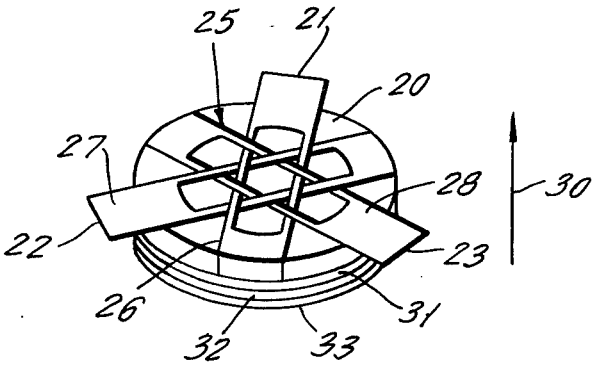
FIG. 1. PRIOR ART
FIG. 1 is a perspective view of a conventional circulator.

Referring to FIG. 1, description will be made at first of a conventional lumped-element circulator for a better understanding of this invention. The circulator comprises a disk-shaped ferrimagnetic piece 20 having a principal surface, a rear surface, a cylindrical side surface, and a center point on the principal surface. Three ports 21, 22, and 23 are azimuthally equally spaced along the circumference of the principal surface. An assembly of lumped-element conductors 25 is placed on the principal surface and connected to the respective ports 21 through 23. The assembly 25 comprises three elongate conductive members 26, 27, and 28, each extended from a relevant one of the ports 21 through 23 beyond the center point and having a pair of wide conductors on both ends and a pair of thin parallel conductors between the wide conductors. One each of the wide conductors of the respective conductor members 26 through 28 is used as the port. The assembly 25 is composed by intertwining the thin conductors as shown. The circulator further comprises a magnet symbolized at 30 by a main stationary magnetic field produced thereby, a circulator conductor 31 on the rear surface of the ferrimagnetic disk 20, a dielectric plate 32 on the circular conductor 31, a ground conductor 33 on the dielectric plate 32, and three conductor coatings connecting the respective ports 21 through 23 to the circular conductor 31 along the side surface of the disk 20. The equivalent circuit of the circulator is therefore of a Y connection. The parallel conductors are fragile. Furthermore, the parallel conductors have to be intertwined skillfully.

Figure 2:
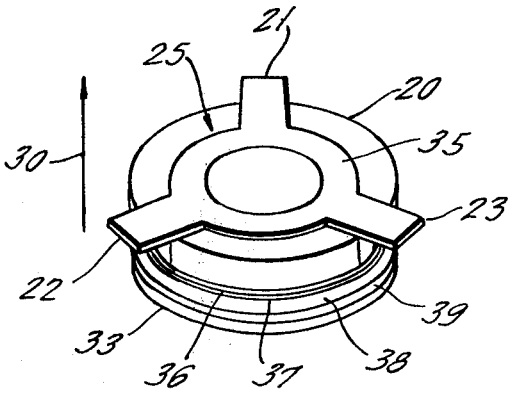
FIG. 2. PRIOR ART
FIG. 2 is a perspective view of another conventional circulator.

Referring to FIG. 2, another conventional circulator is substantially the same as a circulator disclosed in the U.S. Patent referred to hereinabove and comprises a ferrite disk 20, three ports 21, 22, and 23 azimuthally equally spaced along the circumference of the principal surface of the disk 20, a magnet symbolized by an arrow 30 for magnetically biasing the disk 20, an assembly of lumped-element conductors 25, and a ground conductor 33. The assembly 25 is provided by a ring-shaped conductor 35 connected on the principal surface to the respective ports 21 through 23. Between the rear surface of the disk 20 and the ground conductor 33, the circulator further comprises three conductor segments 36 on the rear surface at positions below the respective ports 21 through 23, three connections between the respective ports 21 through 23 and the conductor segments 36, a first dielectric plate 37 on the conductor segments 36, a conductor disk 38 on the dielectric plate 37, and a second dielectric plate 39 between the conductor disk 38 and the ground conductor 33. The equivalent circuit of the circulator is therefore of a delta connection. As will readily be understood, it is easier to assemble the circulator as compared with that described with reference to FIG. 1.

Figure 3:
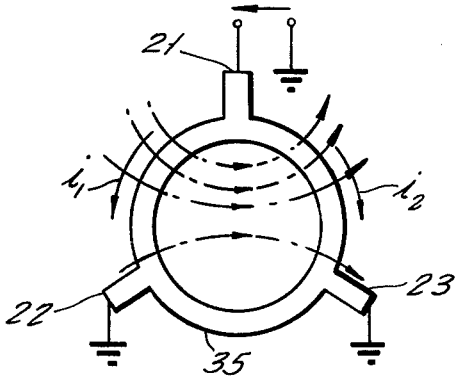
FIG. 3. PRIOR ART
FIG. 3 is a schematic view of the circulator illustrated in FIG. 2 for describing the operation thereof.

Referring to FIG. 3, an analysis will be made of a circulator illustrated with reference to FIG. 2. The magnet (not shown in FIG. 3) produces a main stationary magnetic field perpendicularly of the ferrimagnetic piece 20 (not shown herein). It is surmised at first that one of the ports 21 is used as an input port for an input microwave signal and that two remaining ports 22 and 23 are grounded. First and second signal currents $i_1$ and $i_2$ flow from the input port 21 to the remaining ports 22 and 23 through those portions of the ring-shaped conductor 35 which serve as two lumped-element conductors. The signal currents $i_1$ and $i_2$ produce additional magnetic fields in the ferrimagnetic disk 20 as symbolized by dashed lines. It is known in the art that the input signal is accompanied at the input port 21 by a linearly polarized magnetic field, on which the main magnetic field superposes circularly polarized magnetic fields, and that the circulator action is dependent only on the circularly polarized fields and not on the linearly polarized field so as to be evaluated by that ratio in the ferrimagnetic disk 20 of the energy of the circularly polarized fields to the energy of the total magnetic field which is called a "nonreciprocal filling factor" in the art. It is also known that the nonreciprocal filling factor depends on the difference between positive and negative effective magnetic permeabilities $\mu_{+eff}$ and $\mu_{-eff}$ of a ferrimagnetic disk 20 for clockwise and counterclockwise rotated magnetic fields.

It is now presumed in FIG. 3 that the above-mentioned remaining ports 22 and 23 are isolated from ground and that the three ports 21 through 23 are excited with a set of three-phase input microwave signals having a common amplitude and a phase difference of 120° relative to one another to produce a magnetic field that revolves in the ferrimagnetic disk 20 in a predetermined one of clockwise and counterclockwise senses of rotation. As described, the three-phase signals produce linearly polarized magnetic fields at the ports 21 through 23. The main and the revolving magnetic fields change the linearly polarized fields only slightly to circularly polarized fields in the adjacency of the ring-shaped conductor 35. Moreover, the magnetic field energy is dense adjacent the conductor 35 and is not at that center area of the ferrimagnetic disk 20 at which considerably circularly polarized fields are produced. It is therefore inevitable that the circulator has a poor nonreciprocal filling factor. On the other hand, an operable band width of a circulator is related to that loaded quality factor, generally denoted by $Q_L$, of the circulator which is related to the nonreciprocal filling factor. The poor nonreciprocal filling factor results in a narrow operable band width.

For a wider operable band width of the circulator, the assembly 25 is usually placed between a pair of ferrimagnetic pieces to avoid leakage of the circularly polarized fields. It is inevitable in the circulator illustrated with reference to FIG. 1 that another ferrimagnetic piece (not shown) placed on the illustrated ferrimagnetic piece 20 is appreciably spaced from the latter. Therefore, an operable band width of the circulator is inevitably rendered narrow.

Figure 4:
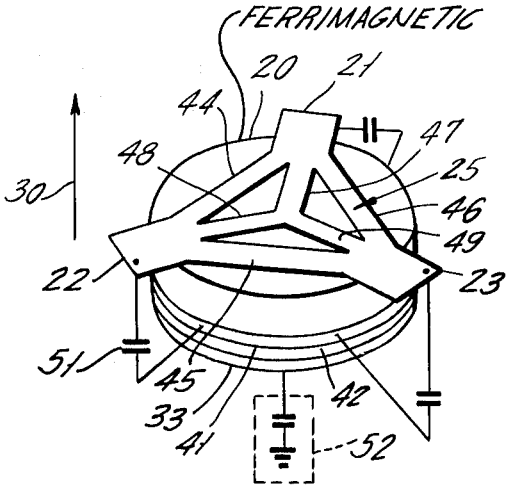
FIG. 4 is a perspective view of a circulator according to a first embodiment of this invention.
Figure 5:
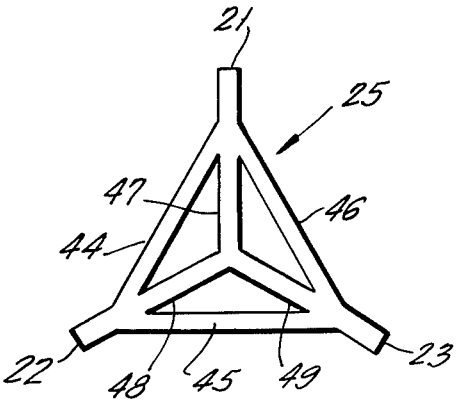
FIG. 5 is a plan view of a conductive pattern used in a circulator according to the first embodiment.

Referring now to FIGS. 4 and 5, a circulator according to a first embodiment of this invention comprises a ferrimagnetic piece 20 of a disk shape having a principal surface, a rear surface, and a center or predetermined point on the principal surface. Three ports 21, 22, and 23 are azimuthally equally spaced along the circumference of the principal surface. The circulator comprises an assembly of lumped-element conductors 25 and a magnet symbolized by an arrow 30 for magnetically biasing the disk 20. The circulator further comprises a ground conductor 33 held on the rear surface of the disk 20 with a conductive plate 41 and a dielectric plate 42 placed between the disk 20 and the ground conductor 33. The assembly 25 is provided by three first conductors 44, 45, and 46 and three second conductors 47, 48, and 49 as bypass conductors of the first conductors 44, 45, and 46. The first conductors 44, 45, and 46 are connected to the respective ports 21, 22, and 23 and to one another at three points of connection to enclose an area of the principal surface. The second conductors 47, 48, and 49 are connected to one another and to the respective three points of connection and placed in the area. The ports 21, 22, and 23, first conductors 44, 45, and 46, and second conductors 47, 48, and 49 are arranged on the principal surface substantially in a geometric configuration having a threefold axis of rotational symmetry. The threefold axis passes perpendicularly of the principal surface through the center point of the piece 20. In the example being illustrated, the three first conductors 44, 45, and 46 are arranged in an equilateral triangle configuration having a center of gravity coincident with the center point of the piece 20. The three second conductors 47, 48, and 49 are extended along three straight lines between each of the respective points of connection and the center of gravity. In addition, each of the ports 21, 22, and 23 is connected through a capacitor 51 to the conductive plate 41 attached directly to the rear surface of the piece 20. The ground conductor 33 is connected to ground through a control circuit 52 which is represented by a capacitor and which is for adjusting or controlling a phase of an eigenvalue in an in-phase mode, as will be described later with reference to FIG. 7. Although the circulator illustrated in this figure is of a microstrip line type wherein the assembly 25 is mounted on the ferrimagnetic piece 20, this invention is readily applicable to a circulator of a strip line type wherein the assembly 25 is placed between a pair of ferrimagnetic pieces.

Figure 6:
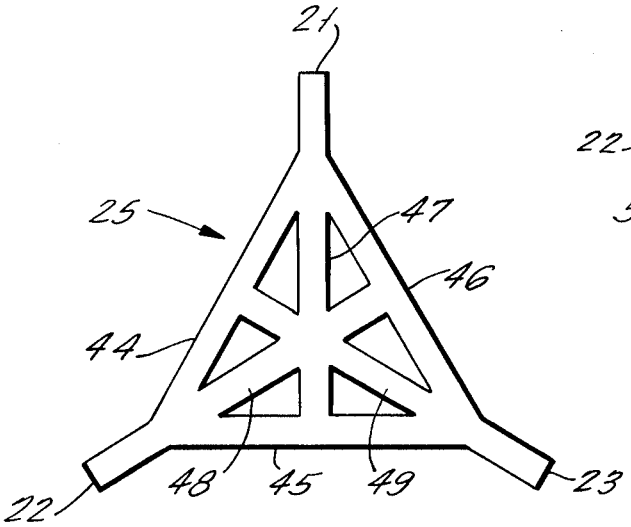
FIG. 6 is a plan view of a conductor for a circulator according to a second embodiment.

Referring to FIG. 6, a circulator according to a second embodiment of this invention is similar to that illustrated with reference to FIGS. 4 and 5 except that use is made of a lumped-element conductor assembly 25 arranged in a geometric configuration different from that of FIGS. 4 and 5. The assembly 25 comprises three first conductors 44, 45, and 46 connected to one another at three points of connection and three second conductors 47, 48, and 49 connected to the respective points of connection and to one another in the area enclosed by the first conductors 44, 45, and 46. Each of the second conductors 47, 48, and 49 is extended along the median lines of the triangle, namely, to one of the first conductors 44, 45, and 46 that is opposite to each of the points.

Referring to FIGS. 4 through 6 again, let it be assumed for analysis of a circulator according to a first or a second embodiment of this invention that the three ports 21 through 23 are supplied with a set of three-phase microwave signals having a common amplitude and a phase difference of 120° relative to one another so as to produce a main revolving magnetic field that revolves in a predetermined one of clockwise and counterclockwise senses of rotation. The revolving field causes those electric currents to flow through the first and second conductors 44 through 46 and 47 through 49 which produce a first and a second revolving magnetic field. Due to the first and second revolving fields cooperating with the main stationary and main revolving fields, the electric currents produce first and second circularly polarized magnetic fields adjacent to the first and second conductors 44 through 46 and 47 through 49, respectively. In-phase electric currents flow through each of the first conductors 44 through 46 and one of the second conductors 47 through 49 that is connected to one of the ports 21 through 23 to which the said each first conductor is connected. The instantaneous vector of the first circularly polarized field produced adjacent to the said each first conductor is therefore coincident in sense with that of the second circularly polarized field produced adjacent to the said one second conductor. The first and second circularly polarized fields thus emphasize each other to improve the nonreciprocal filling factor.

Figure 7:
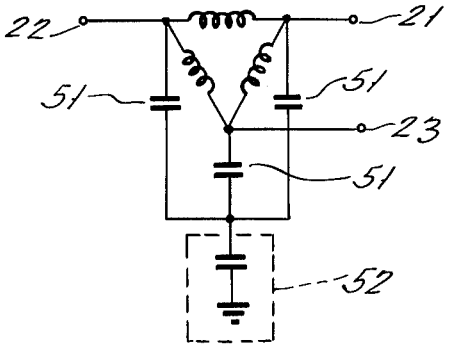
FIG. 7 is an equivalent circuit diagram of a circulator according to the first embodiment of this invention.

Referring to FIG. 7, description will be made of an equivalent circuit of and an analysis of a circulator according to a first or a second embodiment illustrated with reference to FIGS. 4 through 6. The first and second conductors are represented by inductive elements delta-connected between three ports 21 through 23. The respective ports 21 through 23 are connected through capacitors 51 to one terminal of the control circuit 52. The control circuit 52 is grounded at the other terminal thereof. The respective inductive elements, the capacitors 51, and the control circuit 52 are operable as tuned circuits. As described in the above-referenced specification, it is necessary for a three-port circulator having a threefold axis of rotational symmetry to perform the circulator action that three eigenvalues or proper values of a three-row three-column scattering matrix for the circulator should have, in an ideal case, a phase difference of 120° between one another. The three eigenvalues correspond to an in-phase mode of excitation of the circulator, a clockwise rotating mode of excitation, and a counterclockwise rotating mode. The two latter modes are described hereinabove in connection with FIG. 3. In the in-phase mode, three in-phase microwave signals of a common amplitude are simultaneously supplied to the three ports. In practice, it is possible to adjust the eigenvalue that corresponds to the in-phase excitation mode. It is therefore sufficient, with a return loss and an isolation of about 20 dB admitted, that the two eigenvalues corresponding to the two counter-rotating modes of excitation have a phase difference between 100° and 140°. The control circuit 52 is for adjusting the eigenvalue of the in-phase mode. The equivalent circuit illustrated in FIG. 7 is substantially equal to that illustrated in the referenced specification in which it is possible to afford sufficiently separate tuning for the in-phase and counter-rotating modes. The circulator according to the first or second embodiments of this invention also performs satisfactory circulator action.

Figure 8:
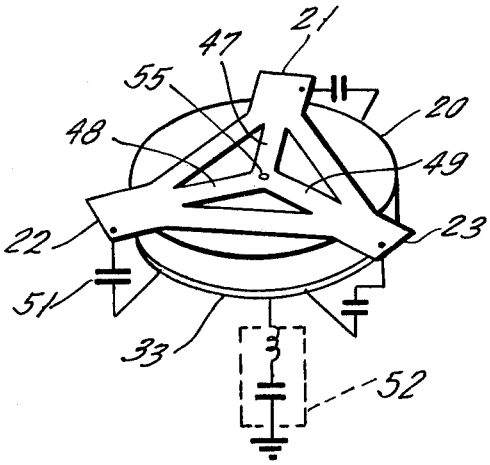
FIG. 8 is a perspective view of a circulator according to a third embodiment of this invention.

Referring to FIG. 8, a circulator according to a third embodiment of this invention comprises a ferrimagnetic piece 20 of a disk shape, three ports 21 through 23, and an assembly 25 substantially similar to that illustrated with reference to FIG. 5. The ferrimagnetic piece 20 has a through hole extended through a center point between principal and rear surfaces thereof. A ground conductor 33 is in contact with the rear surface of the ferrimagnetic piece 20. As is the case with the other embodiments, the assembly 25 comprises three second conductors 47, 48, and 49 connected to one another on the through hole. The second conductors 47, 48, and 49 are electrically connected through the through hole to the ground conductor 33 at a center area 55 connected to one another. Between the respective ports 21 through 23 and the ground conductor 33, capacitors 51 are connected. The ground conductor 33 is grounded through a control circuit 52 comprising a series circuit of an inductance and a capacitor. Use may be possible of a double tuning circuit as the control circuit 52.

Figure 9:
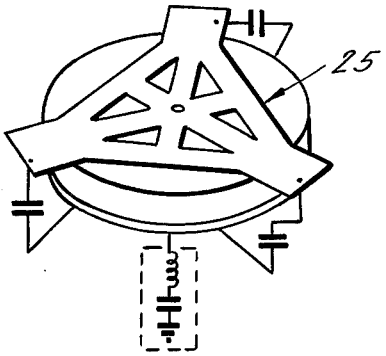
FIG. 9 is a perspective view of a circulator according to a fourth embodiment of this invention.

Referring to FIG. 9, a circulator according to a fourth embodiment of this invention is similar to that illustrated with reference to FIG. 8. The only difference resides in the fact that use is made herein of a lumped-element conductor assembly 25 of the type described in conjunction with FIG. 6.

Figure 10:
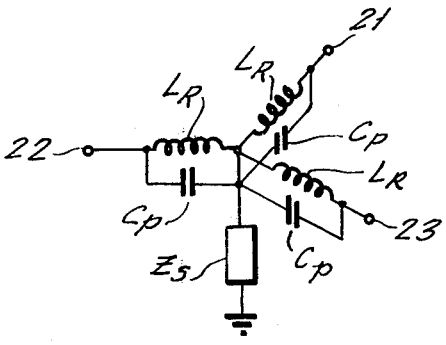
FIG. 10 is a general equivalent circuit diagram of the circulators according to the first and second embodiment of this invention.

Turning to FIG. 10, it is to be understood at first in connection with the circulators according to the third and fourth embodiments of this invention that it is possible to describe the first conductors 44 through 46 by a delta-connected equivalent circuit. The delta connection is readily converted to a first Y-connected equivalent circuit. The second conductors 45 through 49 are represented by a second Y-connected equivalent circuit. An equivalent circuit common to the circulators according to the third and fourth embodiments is therefore a Y connection having three arms each of which consists of an inductance $L_R$ resulting from the first and second conductors and a parallel capacitance $C_P$ representative of each of the capacitors 51. It is possible to convert the delta connection shown in FIG. 7 to the Y connection. The following analysis therefore applies also to the circulators according to the first and second embodiments. Let it now be assumed that the circulator is excited in one or the other of two different modes, one being an in-phase mode of simultaneously supplying three in-phase microwave signals of a common amplitude to the three ports 21 through 23 and the other, a counter-rotating mode of supplying the three-phase microwave signals to the ports 21 through 23 in the above-described manner. In the in-phase mode, the control circuit 52 is represented by an impedance $Z_S$ connected between the center area 55 of the assembly 25 and ground. This is because no current flows through the capacitors $C_P$ between the ports 21 through 23 and the center area 55. In the counter-rotating mode, the control circuit 52 is equivalent to a short because no current flows between the center area 55 and ground. It is therefore possible to control the impedance $Z_S$ so as to achieve an optimum condition for the in-phase mode excitation regardless of the optimum condition for the counter-rotating mode excitation.

Figure 11:
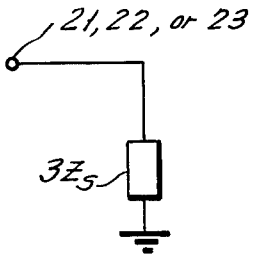
FIG. 11 is an equivalent circuit diagram in an in-phase mode of excitation of the equivalent circuit illustrated in FIG. 10.

Referring to FIG. 11, it is possible to represent for the in-phase mode excitation the equivalent circuit shown in FIG. 10 merely by an impedance $3Z_S$ connected between each of the three ports 21 through 23 and ground.

Figure 12:
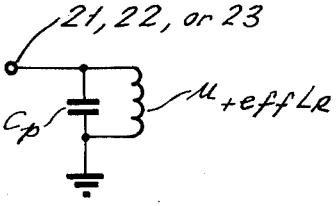
FIG. 12 is an equivalent circuit diagram in a rotating mode of excitation of the equivalent circuit.
Figure 13:
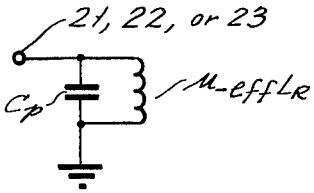
FIG. 13 is an equivalent circuit diagram in the other rotating mode of excitation.

Referring to FIGS. 12 and 13, it is possible for counter-rotating modes of excitation of producing the above-mentioned clockwise and counterclockwise revolving magnetic fields to represent the equivalent circuit depicted in FIG. 10 by a parallel connection of the capacitance $C_P$ and an inductance connected between each of the three ports 21 through 23 and ground. The inductance of the parallel connection is equal to $\mu_{+eff}L_r$ and $\mu_{-eff}L_R$ for the clockwise and counterclockwise counter-rotating modes of excitation. As described hereinabove, the difference between the two effective magnetic permeabilities $\mu_{+eff}$ and $\mu_{-eff}$ increases with the nonreciprocal filling factor.

Further referring to FIGS. 12 and 13, it is known for the circulator action that the inductance $L_R$ shown in FIG. 10 should satisfy the following equation:

$$L_R=\sqrt{3}Z_0(1/\mu_{+eff}-1/\mu_{-eff})/(2\omega), \quad (1)$$

where $Z_0$ represents the characteristic impedance of a line connected to each of the ports 21 through 23 and $\omega$, the angular frequency of the input microwave signal. As is obvious from Equation (1), the inductance $L_R$ is proportional to the difference between the reciprocals of the effective permeabilities $\mu_{+eff}$ and $\mu_{-eff}$. Accordingly, the inductance $L_R$ becomes greater when the difference between the permeabilities is larger. The loaded quality factor $Q_L$ of the circulator decreases with an increase in the inductance $L_R$. It is therefore desirable for a wide operable band width to render the difference therebetween larger. On the other hand, the specific operable band width, namely, a ratio of the operable band width to the center frequency of the band is proportional to the nonreciprocal filling factor as taught by Y. Konishi in his article entitled "High Power UHF Circulator," IEEE, MTT-15, pp. 700–708 (December 1967). It is therefore also desirable to render the higher nonreciprocal filling factor greater.

The operable band width of a circulator is determined by a frequency range in which the phase difference between the two eigenvalues for the clockwise and counterclockwise counter-rotating modes is between about 100° and 140°. Judged from these values of the phase difference, circulators according to the first and second embodiments actually had an operable band width between 2.6 GHz and 3.1 GHz and a specific band width of 17.5%. A circulator of the conventional type illustrated with reference to FIG. 2 had an operable band width between 1.48 GHz and 1.64 GHz and a specific band width of 10%.

While several preferred embodiments of this invention have so far been described, it is now readily possible for those skilled in the art to modify the illustrated embodiments in various manners. For example, use is possible of a pair of ferrimagnetic pieces to place the first and second conductors therebetween for a wide operable band width. In addition, the first and second conductors may be arranged in an arbitrary geometric configuration having a threefold axis of rotational symmetry. For example, it is possible to arrange the first conductors like a ring illustrated in FIG. 2.

What is claimed is:

1. A three-port lumped-element circulator comprising:

three ports;

a ferrimagnetic piece having a principal surface and a predetermined point on said principal surface;

means for producing a magnetic field substantially perpendicularly of said principal surface;

three first conductors connected to the respective ports and to one another at three points of connection to enclose an area of said principal surface; and three second conductors connected to one another and to the respective points of connection and placed in said area and on said predetermined point;

said ports, said first conductors, and said second conductors being arranged on said principal surface substantially in a geometric configuration having a threefold axis of rotational symmetry that passes perpendicularly of said principal surface through said predetermined point.

2. A three-port lumped-element circulator as claimed in claim 1, said ferrimagnetic piece having a rear surface opposed to said principal surface and a through hole extended through said predetermined point between said principal and rear surfaces, said circulator further comprising conductive means on said rear surface, wherein said second conductors are electrically connected to said conductive means through said through hole.

3. A three-port lumped-element circulator as claimed in claim 1, wherein said first conductors are arranged in an equilateral triangle configuration, said second conductors being extended along straight lines perpendicularly of said threefold axis.

4. A three-port lumped-element circulator as claimed in claim 3, wherein the second conductor connected to each of said points of connection is extended to one of said first conductors that is opposite to each of said points.

* * * * *